US010758799B2

(12) United States Patent
Orlando et al.

(10) Patent No.: US 10,758,799 B2
(45) Date of Patent: Sep. 1, 2020

(54) TEACHING DEVICE FOR IMPROVING SCOOPING TECHNIQUE FOR GROUND BALLS IN LACROSSE

(71) Applicants: James E Orlando, Mount Sinai, NY (US); Richard Cucciniello, Mount Sinai, NY (US)

(72) Inventors: James E Orlando, Mount Sinai, NY (US); Richard Cucciniello, Mount Sinai, NY (US)

( * ) Notice: Subject to any disclaimer, the term of this patent is extended or adjusted under 35 U.S.C. 154(b) by 0 days.

(21) Appl. No.: 16/122,556

(22) Filed: Sep. 5, 2018

(65) Prior Publication Data

US 2020/0070025 A1 Mar. 5, 2020

(51) Int. Cl.

| | |
|---|---|
| ***A63B 69/00*** | (2006.01) |
| ***A63B 47/00*** | (2006.01) |
| *A63B 102/14* | (2015.01) |

(52) U.S. Cl.

CPC ..... *A63B 69/00* (2013.01); *A63B 47/002* (2013.01); *A63B 2102/14* (2015.10)

(58) Field of Classification Search

CPC .... A63B 69/00; A63B 47/002; A63B 2102/14

USPC ..... 473/446, 422, 471–478, 454

See application file for complete search history.

(56) References Cited

U.S. PATENT DOCUMENTS

| | | | | | |
|---|---|---|---|---|---|
| 3,260,527 | A * | 7/1966 | Younce | A63B 63/00 | 473/166 |
| 3,865,375 | A * | 2/1975 | Cosgrove | A63B 63/00 | 273/118 R |
| 4,021,036 | A * | 5/1977 | Nelson | A63B 47/002 | 473/459 |
| 4,735,405 | A * | 4/1988 | Marocco | A63B 69/409 | 124/50 |
| 4,830,372 | A * | 5/1989 | Outlaw | A63B 47/002 | 124/16 |
| 5,018,731 | A * | 5/1991 | Doyle | A63B 63/00 | 473/164 |
| 5,066,010 | A * | 11/1991 | Pingston | A63B 47/002 | 473/451 |
| 5,249,564 | A * | 10/1993 | Peachey | A63B 69/40 | 124/17 |
| 5,470,067 | A * | 11/1995 | Diresta | A63B 47/002 | 473/282 |
| 5,615,880 | A * | 4/1997 | Booth | A63B 24/0021 | 473/478 |

(Continued)

*Primary Examiner* — Mitra Aryanpour

(74) *Attorney, Agent, or Firm* — Carter, DeLuca & Farrell LLP

(57) ABSTRACT

A lacrosse teaching device includes a body, a ball receptacle, and a valve. The body includes a first leg, a second leg, and an archway interconnecting the first and second legs. The body defines a tunnel and the archway defines an opening. A ball receptacle defines a cavity and an opening. The cavity is dimensioned to hold at least one lacrosse ball. The ball receptacle communicates with the opening in the archway such that a lacrosse ball can travel from the cavity of the ball receptacle through the opening in the archway and into the tunnel. The valve is positioned between the cavity of the ball receptacle and the opening in the archway and is actuable to control movement of the at least one lacrosse ball from the cavity of the ball receptacle into the opening in the archway.

20 Claims, 2 Drawing Sheets

(56) References Cited

U.S. PATENT DOCUMENTS 6,929,570 B2 * 8/2005 Forman, III ..... A63B 69/0095 473/459
7,001,289 B1 * 2/2006 Polega ..... A63B 47/002 473/459
7,244,198 B2 * 7/2007 Morshed ..... A63B 47/002 473/459
7,500,927 B2 * 3/2009 Morshed ..... A63B 47/002 473/459
7,549,415 B2 * 6/2009 Karellas ..... A63B 69/002 124/16
7,662,054 B2 * 2/2010 Erickson ..... A63B 63/004 473/422
7,691,012 B2 * 4/2010 Cucjen ..... A63B 69/406 473/451
8,371,964 B2 * 2/2013 Jones ..... A63B 69/0095 473/422
8,480,517 B2 * 7/2013 Guttler ..... A63B 47/002 473/422
9,555,307 B1 * 1/2017 Lewis ..... A63B 69/409 473/454
9,616,308 B2 * 4/2017 Gilman ..... A63B 63/06 473/478
10,039,967 B2 * 8/2018 Dunser ..... A63B 63/00
2002/0005614 A1 * 1/2002 Krull ..... A63B 65/12 273/355
2002/0042312 A1 * 4/2002 Decloux ..... A63B 63/004 473/476
2002/0165048 A1 * 11/2002 Parkinson ..... A63B 69/406 473/459
2008/0182687 A1 * 7/2008 Ahern ..... A63B 63/00 473/480
2010/0147345 A1 * 6/2010 Zheng ..... A63B 9/00 135/143
2017/0072282 A1 * 3/2017 Lewis ..... A63B 69/409 473/454

* cited by examiner

TEACHING DEVICE FOR IMPROVING SCOOPING TECHNIQUE FOR GROUND BALLS IN LACROSSE

BACKGROUND

1. Technical Description

The present disclosure is directed to a lacrosse teaching device and, more particularly, to a lacrosse teaching device for improving a player's ground ball scooping technique.

2. Background of Related Art

According to the National Collegiate Athletic Association (NCAA), lacrosse is the fastest growing sport in college athletics. Up until recently, competitive lacrosse in the United States was primarily found in the northeast. However, lacrosse is now played collegiately throughout the United States. In fact, Denver University, which is located in Denver Colo., won the men's division I National Championship in 2015. Due to its rising popularity, the availability of college scholarships for college lacrosse has also increased greatly.

There is a saying in lacrosse "ground balls win games." A ground ball is a ball that is not possessed by either lacrosse team. In lacrosse, possession of the ball is important. Typically, the teams that win the ground ball battle control ball possession during the game. There is a technique to scooping ground balls. This technique involves stepping into the ball and protecting sides of the ball with the feet and legs, staying low with the body and the stick, and scooping up the ball. Staying low with the body and the stick facilitates protecting the ball as well as scooping up the ball.

A continuing need exists in the art for a teaching device that can improve a player's technique for scooping up ground balls in lacrosse.

SUMMARY

One aspect of the present disclosure is directed to a lacrosse teaching device including a body, a ball receptacle, and a valve. The body includes a first leg, a second leg, and an archway interconnecting the first leg and the second leg. The body defines a tunnel and the archway defines an opening. The ball receptacle defines a cavity and an opening. The cavity is dimensioned to hold at least one lacrosse ball. The ball receptacle communicates with the opening in the archway such that a lacrosse ball of the at least one lacrosse ball can travel from the cavity of the ball receptacle through the opening in the archway and into the tunnel. The valve is positioned between the cavity of the ball receptacle and the opening in the archway and is actuable to control movement of the at least one lacrosse ball from the cavity of the ball receptacle into the opening in the archway.

In embodiments, the ball receptacle is funnel shaped and the at least one lacrosse ball includes a plurality of lacrosse balls.

In some embodiments, the ball receptacle includes a cover to close the opening in the ball receptacle.

In certain embodiments, the valve is remotely controlled.

In embodiments, the valve is timer controlled.

In some embodiments, the valve is manually controlled.

In certain embodiments, a length of each of the first and second legs is adjustable to adjust a height of the tunnel.

In embodiments, each of the first and second legs includes a first portion connected to the archway and a second portion, the first portions being movable in relation to the second portions to adjust the length of each of the first and second legs.

In some embodiments, the first and second portions of each of the first and second legs are telescopingly connected.

In certain embodiments, the first portion of each of the first and second legs defines a plurality of first openings and the second portion of each of the first and second legs includes a second opening, the second opening being selectively movable into alignment with one of the plurality of first openings to fix the first and second legs at a selected length.

In embodiments, the lacrosse training device includes pegs that are received through the first and second openings of the first and second leg portions to fix the lengths of the first and second legs.

In some embodiments, a base member supported on each of the second portions of each of the first and second legs, the base members being dimensioned and configured to stabilize the body of the lacrosse teaching device on a support surface.

In certain embodiments, the base members include securement structure to secure the base members to a support surface.

In embodiments, the securement structure includes one or more spikes.

In some embodiments, the base members define openings to receive the one or more spikes.

BRIEF DESCRIPTION OF THE DRAWINGS

Various embodiments of the presently disclosed lacrosse teaching device are described herein below with reference to the drawings, wherein.

DETAILED DESCRIPTION OF EMBODIMENTS

Figure 1:
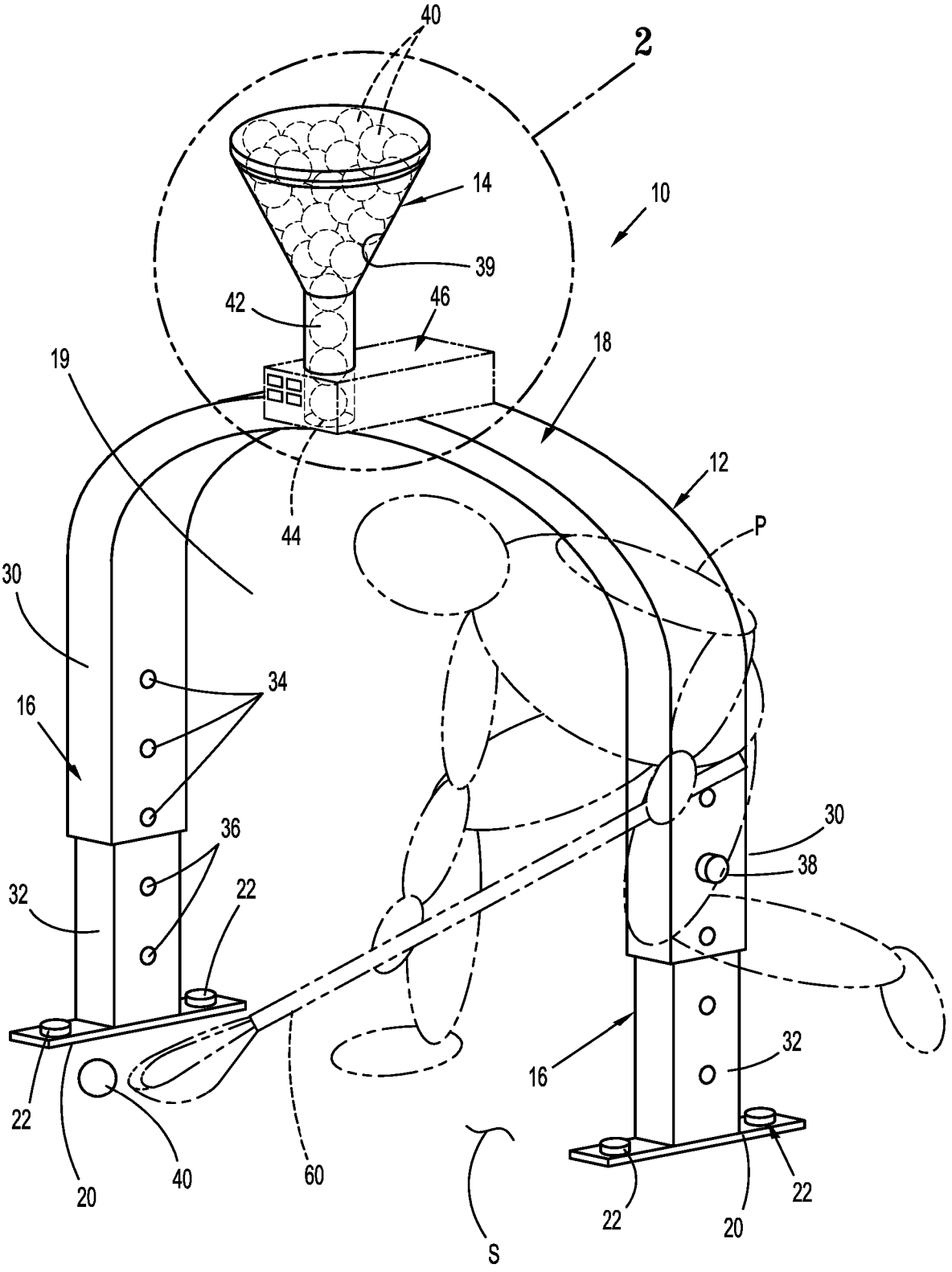
FIG. 1 is a side perspective view of an exemplary embodiment of the presently disclosed lacrosse teaching device with a player positioned within the device shown in phantom.

The presently disclosed lacrosse teaching device will now be described in detail with reference to the drawings in which like reference numerals designate identical or corresponding elements in each of the several views. However, it is to be understood that the disclosed embodiments are merely exemplary of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure.

Figure 2:
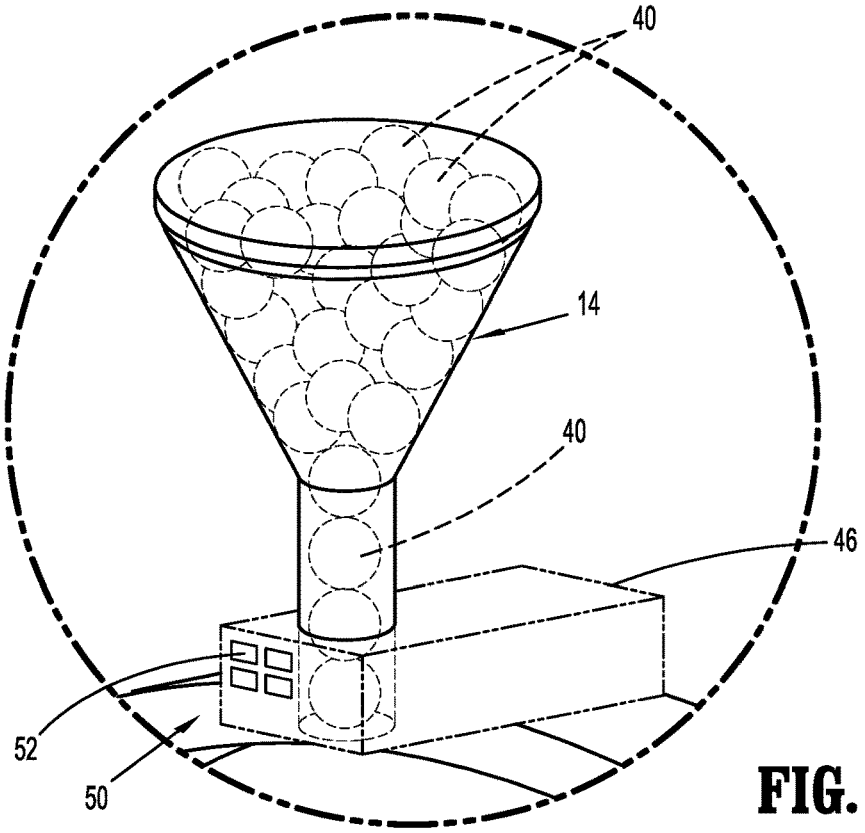
FIG. 2 is an enlarged view of the indicated area of detail shown in FIG. 1.
Figure 3:
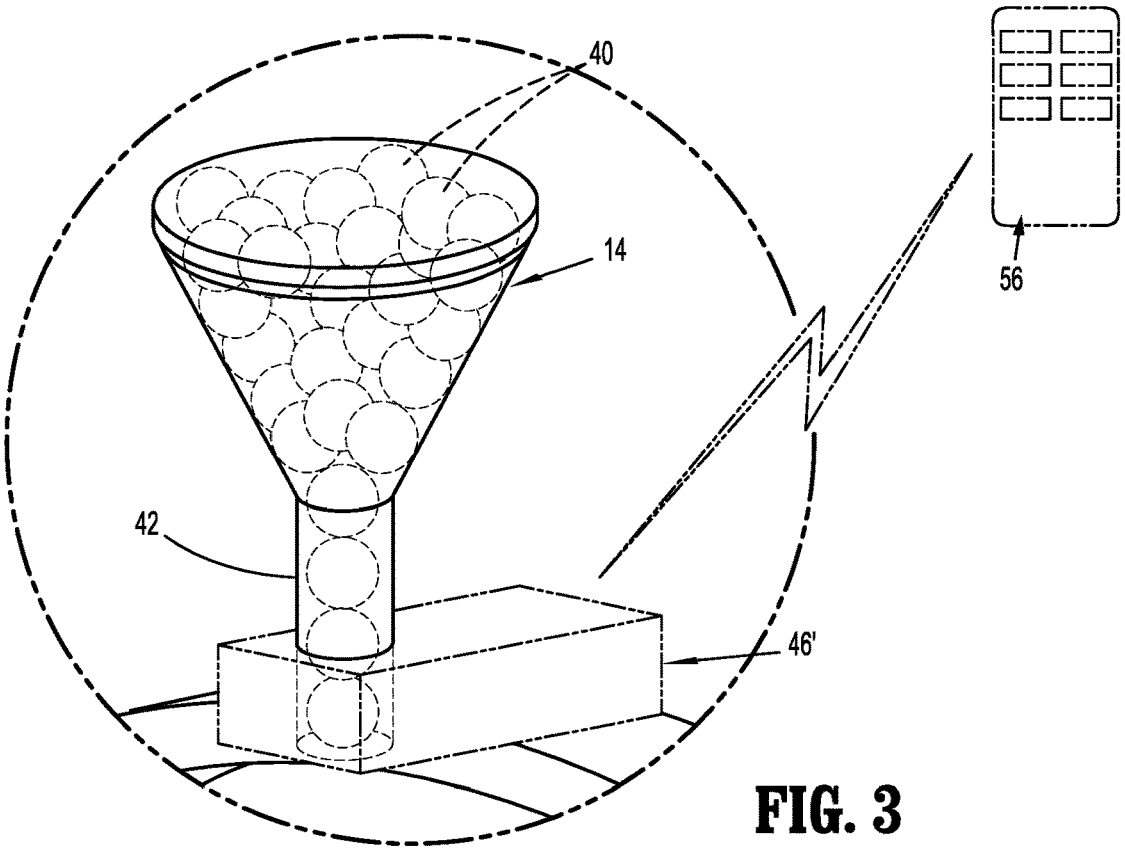
FIG. 3 is another exemplary embodiment of a ball receptacle and valve of the presently disclosed lacrosse teaching device shown in FIG. 1.

The presently disclosed lacrosse teaching device is shown generally in FIGS. 1-3 as teaching device 10 and includes a body 12, and a lacrosse ball receptacle 14. The body 12 includes spaced legs 16 and an archway 18 that extends between the spaced legs 16 to define a tunnel or passageway 19 beneath the archway 18. In embodiments, the legs 16 each include a base member 20 that has an area that is greater than the area define by a cross-section of the legs 16 to provide a stable support surface for the body 12. The base members 20 may include or be adapted to receive structure to facilitate securement of the base members 20 to a support surface "S". For example, the base members 20 may define openings (not shown) that receive spikes 22 that can penetrate the support surface "S" to secure the body 12 to the support surface "S". It is envisioned that the body 12 of the teaching device 10 may include a variety of different types of securement devices other than spikes 22 to secure the body 12 to the support surface "S". It is also envisioned that if spikes 22 are provided, the spikes 22 should be provided with atraumatic or unsharpened tips (not shown) to avoid injury to a player. In some embodiments, the area of the base members 20 can be increased to obviate the need for securement devices such as spikes. For example, the width and/or length of the base members 20 can be increased to provide a more stable support surface for the body 12 of the teaching device 10.

In embodiments, each of the legs 16 includes a first portion 30 that is coupled to the archway 18 and a second portion 32 that is coupled to the base member 20. Each of the first portions 30 is coupled to a respective second portion 32 to facilitate adjustment of the length of the leg 16. In embodiments, the first portion 30 of each leg 16 is dimensioned and configured to telescopingly receive the second portion 32 of each leg 16 to allow the length of the legs 16 to be selectively adjusted. Alternately, the second portion 32 of each leg 16 can be dimensioned and configured to telescopingly receive the first portion 30 of each leg 16. In some embodiments, each of the first leg portions 30 define holes 34 and each of the second portions 32 of the legs 16 define at least one hole 36. Any one of the holes 34 of the first leg portion 30 can be aligned with the hole 36 of the second leg portion 32 to receive a peg 38 to secure the first and second leg portions 30 and 32 in relation to each other to set the legs 16 to a desired length or height. The adjustability of the length of the legs 16 allows the teaching device 10 to be adjusted to accommodate athletes of different sizes and ages.

The ball receptacle 14 is supported atop the archway 18 and defines a cavity 39 that is dimensioned to hold at least one lacrosse ball 40 and in some embodiments a plurality of lacrosse balls 40. The ball receptacle 14 includes an outlet tube 42 that communicates with an opening 44 in the archway 18. When a lacrosse ball 40 moves through the outlet tube 42 and through the opening 44 in the archway 18, the lacrosse ball 40 is deposited in the tunnel 16 beneath the archway 18.

In embodiments, a valve or ball drop mechanism 46 is positioned between the outlet tube 42 of the ball receptacle 14 and the opening 44 in the archway 18 to control the passage of lacrosse balls 40 from the cavity 19 of the ball receptacle 14 to the opening 44 in the archway 18. In embodiments the valve 46 can be controlled by a timer 50. For example, the timer 50 can be programmed via the buttons 52 (FIG. 2) to drop a lacrosse ball 40 into the tunnel 19 at a predetermined rate, e.g., every 15 to 60 seconds.

In an alternative embodiment, the valve 46 can be remotely controlled with a remote controlled device 56 (FIG. 3) to selectively drop a lacrosse ball 40 into the tunnel on demand. The remote controlled device 56 can send a signal to the valve 46 wirelessly via radio frequency ("RF") or the like. Alternately, the valve 46 can be a manually controlled device that can be selectively actuated by an instructor or coach to drop a lacrosse ball 40 into the tunnel 19.

Referring to FIG. 1, in use during lacrosse training, the coach or instructor can load one or more lacrosse balls 40 into the ball receptacle 14 and subsequently actuate the valve 46 to drop a lacrosse ball 40 into the tunnel 19. When a lacrosse ball 40 is dropped into the tunnel 19, a player "P" can enter the tunnel 19 to scoop the lacrosse ball 40 with the lacrosse stick 60. As illustrated, the height of the tunnel 19 can be set to require the player "P" to lower her body "B" and stick "S" to access the tunnel 19. This exercise will reinforce good habits when attempting to retrieve or scoop a ground ball.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described, except as indicated by the appended claims.

What is claimed is:

1. A lacrosse teaching device comprising:

a body including a first leg having an upper end and a lower end, a second leg having an upper end and a lower end, and an archway interconnecting the upper ends of the first and second legs, the lower ends of the first and second legs being spaced and disconnected from each other, the body defining a tunnel that is dimensioned to allow a lacrosse player carrying a lacrosse stick to pass through the tunnel in position to scoop a groundball, the first and second legs having a length that is adjustable to facilitate adjustment of a height of the tunnel;

a ball receptacle supported on the archway above the tunnel, the ball receptacle defining a cavity and an opening, the cavity being dimensioned to hold at least one lacrosse ball, the ball receptacle being positioned such that a lacrosse ball of the at least one lacrosse ball can travel from the cavity of the ball receptacle through the opening in the ball receptacle vertically downwardly into the tunnel; and a valve communicating with the opening in the ball receptacle, the valve being actuable to control movement of the at least one lacrosse ball from the cavity of the ball receptacle into the tunnel.

2. The lacrosse teaching device of claim 1, wherein the ball receptacle is funnel shaped and the at least one lacrosse ball includes a plurality of lacrosse balls.

3. The lacrosse teaching device of claim 1, wherein the ball receptacle includes a cover to enhance the opening.

4. The lacrosse teaching device of claim 1, wherein the valve is remotely controlled.

5. The lacrosse teaching device of claim 1, wherein the valve is timer controlled.

6. The lacrosse teaching device of claim 1, wherein the valve is manually controlled.

7. The lacrosse teaching device of claim 1, wherein a length of each of the first and second legs is adjustable to adjust a height of the tunnel.

8. The lacrosse teaching device of claim 7, wherein each of the first and second legs includes a first portion connected to the archway and a second portion, the first portions being movable in relation to the second portions to adjust the length of each of the first and second legs.

9. The lacrosse teaching device of claim 8, wherein the first and second portion of each of the first and second legs are telescopingly connected.

10. The lacrosse teaching device of claim 9, wherein the first portion of each of the first and second legs defines a plurality of first openings and the second portion of each of the first and second legs includes a second opening, the second opening being selectively movable into alignment with one of the plurality of first openings to fix the first and second legs at a selected length.

11. The lacrosse teaching device of claim 10, further including pegs, the pegs being dimensioned to be received through the first and second openings of each of the first and second legs to fix the length of the first and second legs.

12. The lacrosse teaching device of claim 8, further including a base member supported on each of the second portions of each of the first and second legs, the base members being dimensioned and configured to stabilize the body of the lacrosse teaching device on a support surface.

13. The lacrosse teaching device of claim 12, wherein the base members include securement structure to secure the base members to a support surface.

14. The lacrosse teaching device of claim 13, wherein the securement structure includes one or more spikes.

15. The lacrosse teaching device of claim 14, wherein the base members define openings to receive the one or more spikes.

16. A lacrosse teaching device comprising:

a body including a first leg having an upper end and a lower end, a second leg having an upper end and a lower end, and an archway interconnecting the upper ends of the first and second legs, the lower ends of the first and second legs being spaced and disconnected from each other, the body defining a tunnel that is dimensioned to allow a lacrosse player carrying a lacrosse stick to pass through the tunnel in position to scoop a groundball;

a ball receptacle supported on the archway above the tunnel, the ball receptacle defining a cavity and an opening, the cavity dimensioned to hold at least one lacrosse ball, the ball receptacle being positioned such that a lacrosse ball of the at least one lacrosse ball can travel from within the cavity of the ball receptacle through the opening in the ball receptacle vertically downwardly into the tunnel; and a valve communicating with the opening in the ball receptacle, the valve being actuable to control movement of the at least one lacrosse ball from the cavity of the ball receptacle into the tunnel.

17. The lacrosse teaching device of claim 16, wherein the valve is remotely controlled.

18. The lacrosse teaching device of claim 16, wherein, the first and second legs have a length that is adjustable to facilitate adjustment of a height of the tunnel.

19. The lacrosse teaching device of claim 18, wherein each of the first and second legs includes a first portion connected to the archway and a second portion, the first portions being movable in relation to the second portions to adjust the length of each of the first and second legs.

20. The lacrosse teaching device of claim 8, further including a base member supported on each of the second portions of each of the first and second legs, the base members being dimensioned and configured to stabilize the body of the lacrosse teaching device on a support surface.

* * * * *